US005601194A

United States Patent [19]

Brinston

[11] Patent Number: 5,601,194

[45] Date of Patent: Feb. 11, 1997

[54] REMOTE CONTROL STAND

[76] Inventor: Lemen K. Brinston, P.O. Box 71592, New Orleans, La. 70172

[21] Appl. No.: 461,108

[22] Filed: Jun. 5, 1995

[51] Int. Cl.[6] ..... A47F 7/00

[52] U.S. Cl. ..... 211/13; 211/60.1; 248/314; 248/176.1

[58] Field of Search ..... 211/13, 89, 60.1; 248/314, 176.1; 206/523, 563, 564, 566

[56] References Cited

U.S. PATENT DOCUMENTS

| | | | |
|---|---|---|---|
| 1,448,338 | 3/1923 | Drew | 248/314 X |
| 2,956,687 | 10/1960 | Robichaud | 248/314 X |
| 2,963,256 | 12/1960 | Borah | 248/314 X |
| 3,003,619 | 10/1961 | Samuels | 206/566 X |
| 3,930,576 | 1/1976 | Stephens | 206/566 X |
| 4,824,059 | 4/1989 | Butler | 248/176.1 |
| 4,917,235 | 4/1990 | Feiler | 206/566 X |
| 5,007,612 | 4/1991 | Manfre | 248/314 X |
| 5,447,243 | 9/1995 | Graber | 211/41 X |
| 5,505,294 | 4/1996 | Kilmartin et al. | 206/566 X |

*Primary Examiner*—Robert W. Gibson, Jr.
*Attorney, Agent, or Firm*—Joseph N. Breaux

[57] ABSTRACT

A remote control stand for storing and organizing remote control units for consumer-type electronic devices including an outer housing having a base portion and an interior chamber having an access opening in connection therewith located at the top of the housing; and first and second resilient members adjacently disposed within the interior chamber in a manner such that a portion of a remote control may be placed between the adjacent surfaces of the first and second resilient members through the access opening. The resilient members are preferably covered with a friction reducing cover on at least an area of the resilient member contacting portions of a remote control.

10 Claims, 4 Drawing Sheets

REMOTE CONTROL STAND

TECHNICAL FIELD

The present invention relates to devices used to support remote controls for electronic equipment and more particularly to devices used to support and organize multiple remote controls for electronic equipment wherein the remote controls are of various sizes and shapes.

BACKGROUND ART

The increasing number of consumer electronic devices having a remote control has created a remote control organizing problem in many homes. Because these remote controls come in various sizes and shapes, it is often difficult to find a satisfactory way of organizing them. It would be a benefit, therefore, to have a remote control organizing device or stand that allowed multiple remote controls to be stored and organized. It would be further benefit if the stand could accommodate a variety of different shaped and sized remote controls without having to be modified.

GENERAL SUMMARY DISCUSSION OF INVENTION

It is thus an object of the invention to provide a remote control stand that will store multiple remote controls in an organized fashion.

It is a further object of the invention to provide a remote control stand that will store multiple remote controls of a variety of shapes and sizes without modifications to the stand.

Accordingly, a remote control stand for storing and organizing remote control units for consumer-type electronic devices is provided. The stand includes an outer housing having a base portion and an interior chamber having an access opening in connection therewith located at the top of the housing; and first and second resilient members adjacently disposed within the interior chamber in a manner such that a portion of a remote control may be placed between the adjacent surfaces of the first and second resilient members through the access opening.

At least one, and preferably both, of the first and second resilient members include recessed areas for receiving portions of remote controls without requiring the degree of deformation of the resilient member required to accommodate the entire portion of the remote control. When both the first and second resilient members included recessed areas one recessed area on the first resilient member and one recessed area on the second resilient member are preferably aligned with one another.

The resilient members are preferably covered with a friction reducing cover on at least an area of the resilient member contacting portions of a remote control. The friction reducing cover is preferably a textile fabric, and more preferably a velvet type textile fabric.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
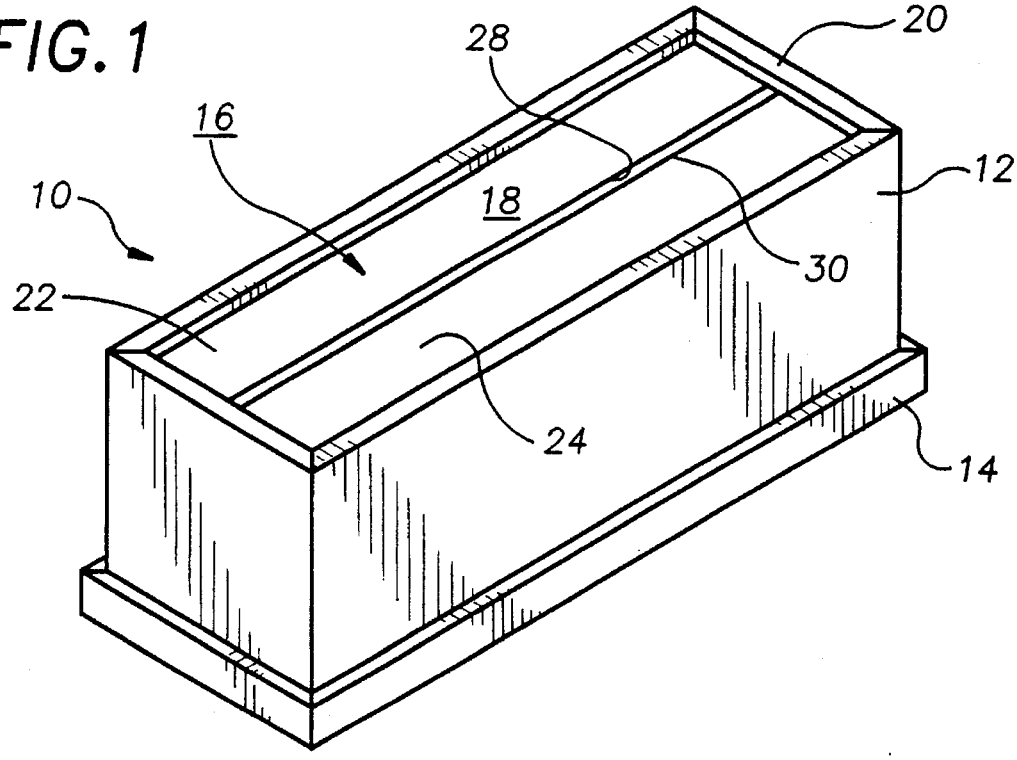
FIG. 1 is a perspective view of an exemplary embodiment of the remote control stand of the present invention.

FIG. 1 is a perspective view of an exemplary embodiment of the remote control stand of the present invention, generally designated by the numeral 10. Stand 10 includes an outer housing 12 having a base portion 14 and an interior chamber 16 having an access opening 18 in connection therewith located at the top 20 of housing 12; and first and second resilient members 22,24 adjacently disposed within interior chamber 16 in manner such that a portion of a remote control may be placed between the adjacent surfaces 28,30 of first and second resilient members 22,24 through access opening 18. In this embodiment, outer housing 12 is a wooden rectangular box having a height of about three inches (3"), a width of about five inches (5"), and a length of about fifteen inches (15").

Figure 2:
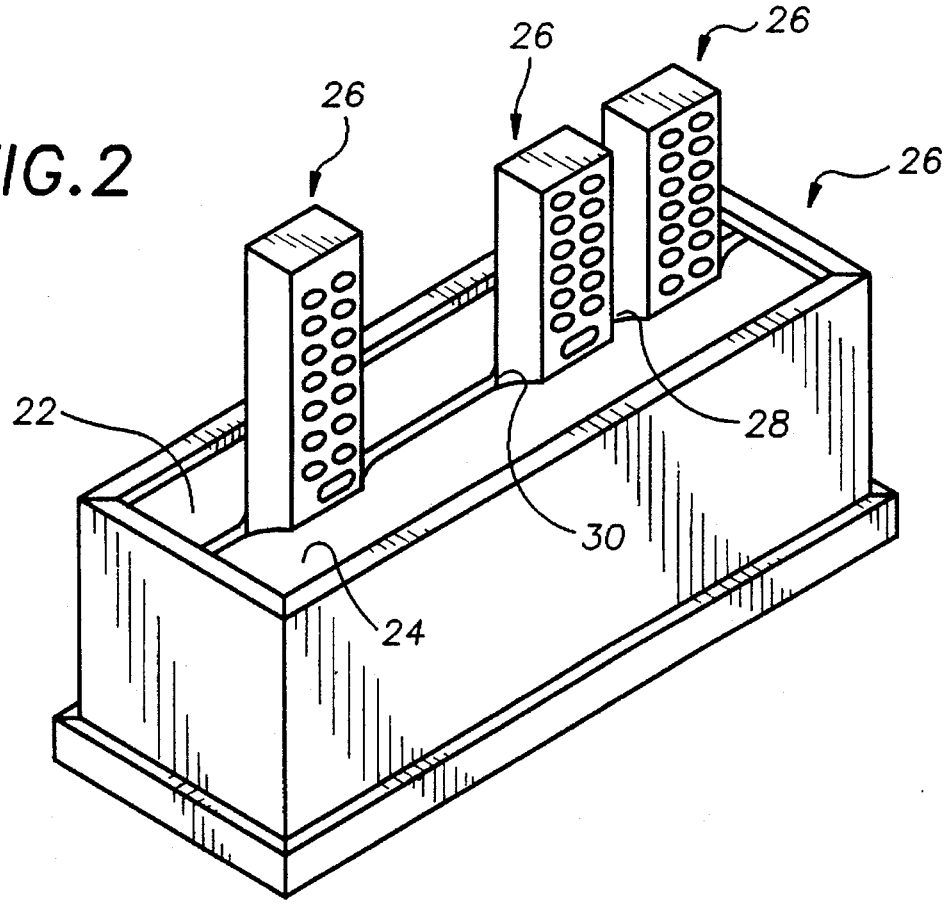
FIG. 2 is a perspective view of the remote control stand of FIG. 1 with three representative remote controls.
Figure 3:
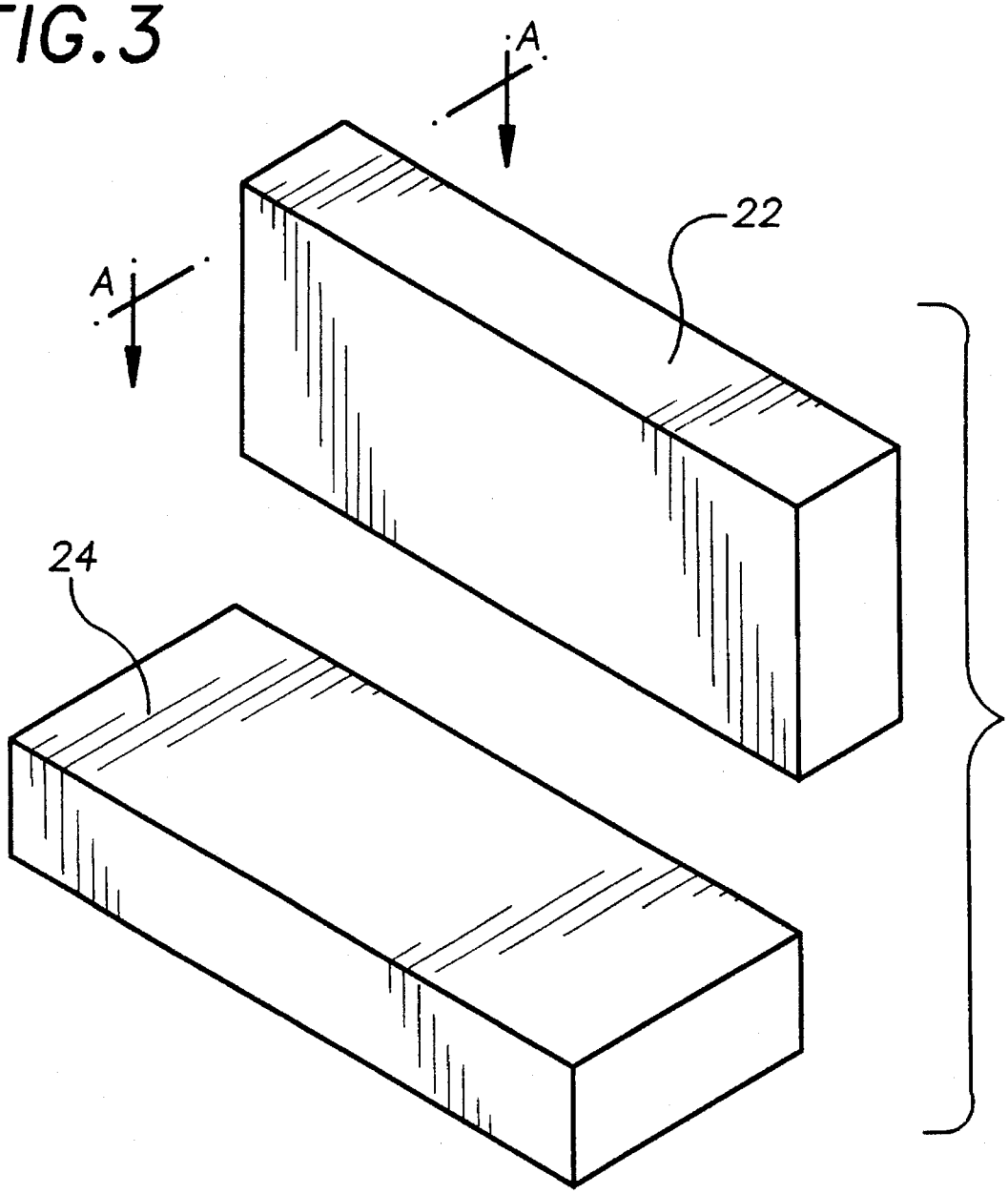
FIG. 3 is a perspective view of the first and second deformable insert members.
Figure 4:
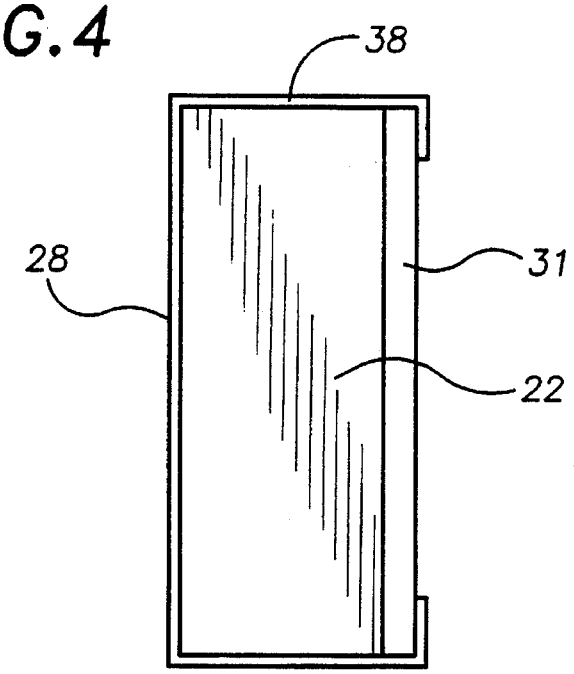
FIG. 4 is a cross-sectional view of the first insert member along the line A—A.

FIG. 2 is a perspective view of remote control stand 10 with three representative remote controls, generally referenced by the numeral 26, installed between adjacent surfaces 28,30 of first and second resilient members 22,24 respectively. In this embodiment each resilient member 22,24 includes a two and three-quarter inch high, by two and one-quarter inch wide, by fourteen and one-half inch long, substantially rectangular section of foam rubber, as shown in FIG. 3 that has been secured to a semi-rigid cardboard substrate and covered with a section of velvet fabric, more clearly shown in FIG. 4. As shown in FIG. 4 a cross-sectional view of resilient member 22 along the line A—A of FIG. 3, each resilient member 22,24 is covered with a layer of velvet material 38 to prevent damage to the surface of remote controls 26 and reduce friction between the surface of the remote controls 26 and adjacent surfaces 28,30. A section of cardboard 31 is adhesively secured to each resilient member 22,24 to reduce curling of the resilient members 22,24 when a remote 26 is inserted between resilient members 22,24 for storage.

Use of remote control stand 10 is now described with general reference to FIGS. 1–4. Remote controls 26 are stored by inserting a portion of the remote between the adjacent surfaces 28,30 of the resilient members. Remotes 26 are held in place until needed by the resilient force from the resilient members. When it is desired to utilize one of the remotes 26, the remote 26 is grasped and pulled free from remote control stand 10.

Figure 5:
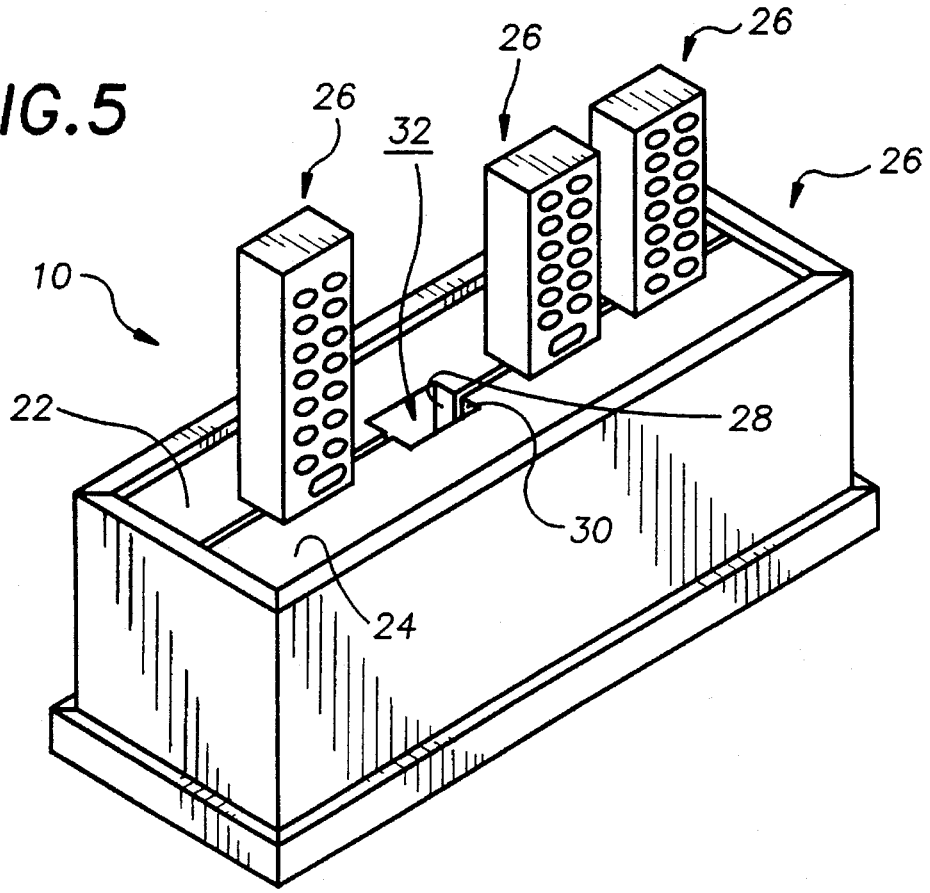
FIGS. 5 and 6 show a second embodiment of the remote control stand.
Figure 6:
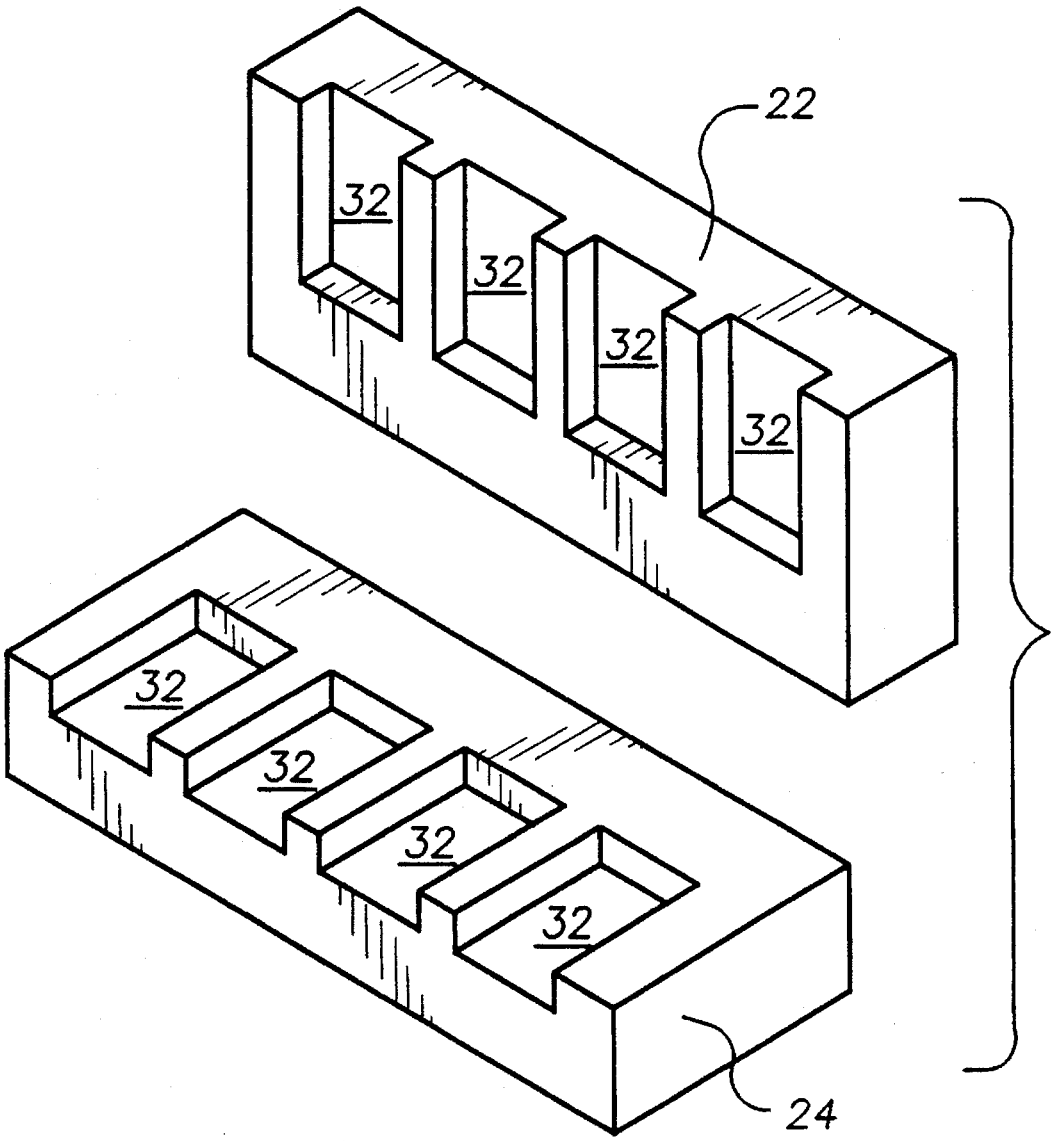

A second embodiment of remote control stand 10 is shown in FIG. 5. In this embodiment, each resilient member 22,24 includes four recessed areas 32. Recessed areas 32 form four remote control receiving partitions. Recessed areas 32 are more clearly seen in FIG. 6. Operation of the embodiment of FIG. 5 is the same as the previous embodiment.

It can be seen from the preceding description that a remote control stand that will store multiple remote controls in an organized fashion, and that will store multiple remote controls of a variety of shapes and sizes without modifications to the stand has been provided.

It is noted that the embodiment of the remote control stand described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A remote control stand comprising:

an outer housing having a base portion and an interior chamber having an access opening in connection therewith located at a top of said housing; and first and second resilient members adjacently disposed within said interior chamber in a manner such that a portion of a remote control may be placed between a first and second adjacent surface of said first and second resilient members, respectively, through said access opening; at least one of said first and second resilient members including recessed areas defined by said adjacent surface.

2. A remote control stand comprising:

an outer housing having a base portion and an interior chamber having an access opening in connection therewith located at a top of said housing; and first and second resilient members adjacently disposed within said interior chamber in a manner such that a portion of a remote control may be placed between a first and second adjacent surface of said first and second resilient members, respectively, through said access opening;

said first resilient member including recessed areas defined by said first adjacent surface;

said second resilient member including recessed areas defined by said second adjacent surface.

3. The remote control stand of claim 2 wherein:

said recessed areas on said first resilient member are aligned with said recessed areas on said second resilient member.

4. The remote control stand of claim 2 wherein:

at least a portion of said adjacent surfaces of said first and second resilient members are covered with a friction reducing cover member.

5. The remote control stand of claim 4 wherein:

said friction reducing cover member is constructed from a textile fabric.

6. The remote control stand of claim 5 wherein:

said textile fabric is a velvet.

7. The remote control stand of claim 1, wherein:

said first resilient member including recessed areas defined by said first adjacent surface;

said second resilient member including recessed areas defined by said second adjacent surface;

said first and second resilient members including a semi-rigid substrate secured to a surface thereof opposite said adjacent surface.

8. The remote control stand of claim 7 wherein:

said recessed areas on said first resilient member are aligned with said recessed areas on said second resilient member.

9. The remote control stand of claim 7 wherein:

at least a portion of said adjacent surfaces of said first and second resilient members are covered with a friction reducing cover member.

10. The remote control stand of claim 9 wherein:

said friction reducing cover member is constructed from a textile fabric.

* * * * *